US005099404A

United States Patent [19]

Kenum

[11] Patent Number: 5,099,404

[45] Date of Patent: Mar. 24, 1992

[54] PORTABLE TUNGSTEN HALOGEN LAMP

[76] Inventor: Louis B. Kenum, Rte. 2, Box 169, Trinity, Ala. 35673

[21] Appl. No.: 564,090

[22] Filed: Aug. 8, 1990

[51] Int. Cl.[5] ..... F21V 15/02

[52] U.S. Cl. ..... 362/376; 362/263

[58] Field of Search ..... 362/376, 377, 378, 263

[56] References Cited

U.S. PATENT DOCUMENTS

| | | | |
|---|---|---|---|
| 1,460,394 | 7/1923 | Tweedy | 362/376 |
| 1,750,870 | 3/1930 | Vooth | 362/376 |
| 2,096,604 | 10/1937 | Bissell | 362/376 |
| 2,228,680 | 1/1941 | Tornblom | 362/376 |
| 2,252,073 | 8/1941 | Gray | 362/376 |
| 2,259,237 | 10/1941 | Baker et al. | 362/376 |
| 2,565,716 | 8/1951 | Boyce | 362/376 |
| 4,019,047 | 4/1977 | Frey | 362/378 |
| 4,275,435 | 6/1981 | Dorn | 362/378 |
| 4,286,311 | 8/1981 | Maglica | 362/202 |
| 4,428,039 | 1/1984 | Guimond et al. | 362/397 |

*Primary Examiner*—Ira S. Lazarus
*Assistant Examiner*—Richard R. Cole
*Attorney, Agent, or Firm*—John C. Garvin, Jr.

[57] ABSTRACT

A portable electric lamp apparatus including a conduit, a tungsten halogen lamp attached to one end of the conduit, a plug attached to the other end of the conduit, a conductor within the conduit for conducting current from the plug to the tungsten halogen lamp, and a retractable guard for protecting or exposing the tungsten halogen lamp. The portable electric lamp is particularly adapted for dispensing a large amount of illumination to large enclosed areas such as boiler furnaces, stokes, tanks and the like which periodically require servicing.

14 Claims, 3 Drawing Sheets

PORTABLE TUNGSTEN HALOGEN LAMP

TECHNICAL FIELD

This invention relates to an electric lamp apparatus, and more particularly to a new and improved portable electric lamp useful for providing light to large enclosed areas. The present invention has application to almost all situations which require the dispersion of a large amount of illumination, but it has particular application for illuminating large enclosed areas such as boiler furnaces, stokers, tanks, coal bunkers, and ducts which periodically require servicing.

BACKGROUND OF THE INVENTION

The prior art abounds with portable trouble or work lights which are primarily used by trademen such as automobile mechanics, carpenters, plumbers and the like which illuminate a relatively small area near his immediate work area. The prior art also includes a limited number of portable trouble lights intended for use to illuminate a relatively large work area. Examples of such prior art lights are shown and described in U. S. Pat. Nos. 4,885,670; 2,096,604; 4,019,047 and 4,262,327.

Most of the prior art trouble or work lamps have the major disadvantage or drawback in that they are capable of dispersing illumination in a small concentrated area only and not over a relatively large area. Many of the prior art work lamps have also had the disadvantage of having to be partially disassembled to replace the bulb which provides the illumination. A still further disadvantage or drawback of many of the known work lamps, particularly those capable of illuminating a relatively large work area, reside in their technical complexity and relatively high cost.

SUMMARY OF THE INVENTION

The instant invention relates to a portable electric lamp, which is relatively simple and inexpensive in construction, capable of providing illumination to a large enclosed area, and overcomes the several disadvantages and drawbacks of the prior art portable lamps. The portable electric lamp of the instant invention can be used by itself or in conjunction with several additional, but identical lamps, when required to illuminate extremely large areas which require servicing such as the interior of boiler furnaces, stokers, tanks or the like. Prior to servicing a large enclosed area, such as a boiler furnace, a person need only to open an observation port and insert a portable electric lamp therein. By appropriately spacing the lamps in the observation ports, the boiler furnace will be adequately illuminated to allow workers to go into the enclosed area defining the boiler furnace to set-up scaffolding and perform the required work within the boiler furnace. After the scaffolding has been set-up, the portable lamps might be moved from the observation ports and possibly attached to the handrails of the scaffolding so that the lamps might be a little closer to the actual work area. While the portable lamp of the instant invention was designed for use in servicing the interior of extremely large enclosed areas, its use is in no way so limited in that it can be used in any area or environment which requires illumination.

It is an object of the present invention to provide a portable electric lamp which is simple and inexpensive in construction and capable of dispensing illumination where needed.

It is a further object of the present invention to provide a portable electric lamp which is capable of dispensing a relatively large amount of illumination within a relatively large enclosed area.

It is still a further object of the present invention to provide a simple and inexpensive portable electric lamp having a lamp protecting guard which can be readily and easily retracted to permit cleaning or replacement of the lamp.

These objects as well as other aspects, objects and advantages of the present invention will become apparent to those skilled in the art after reading the following description of the preferred embodiment in conjunction with the accompanying drawings, and the appended claims.

DETAILED DESCRIPTION OF THE INVENTION

Figure 1:
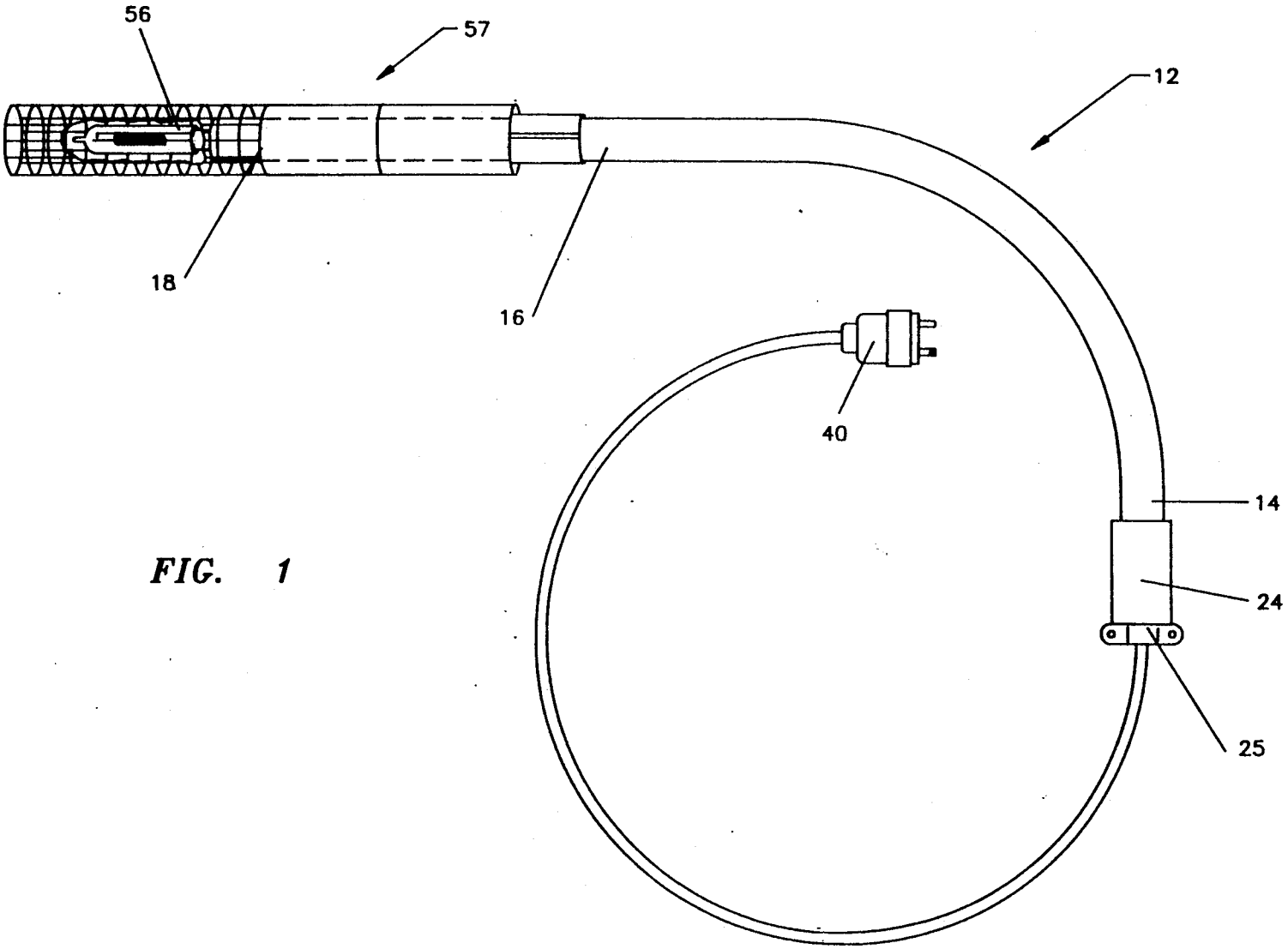
FIG. 1 is a perspective view of the portable electric lamp of the present invention showing its retractable guard in the lamp protecting position.
Figure 2:
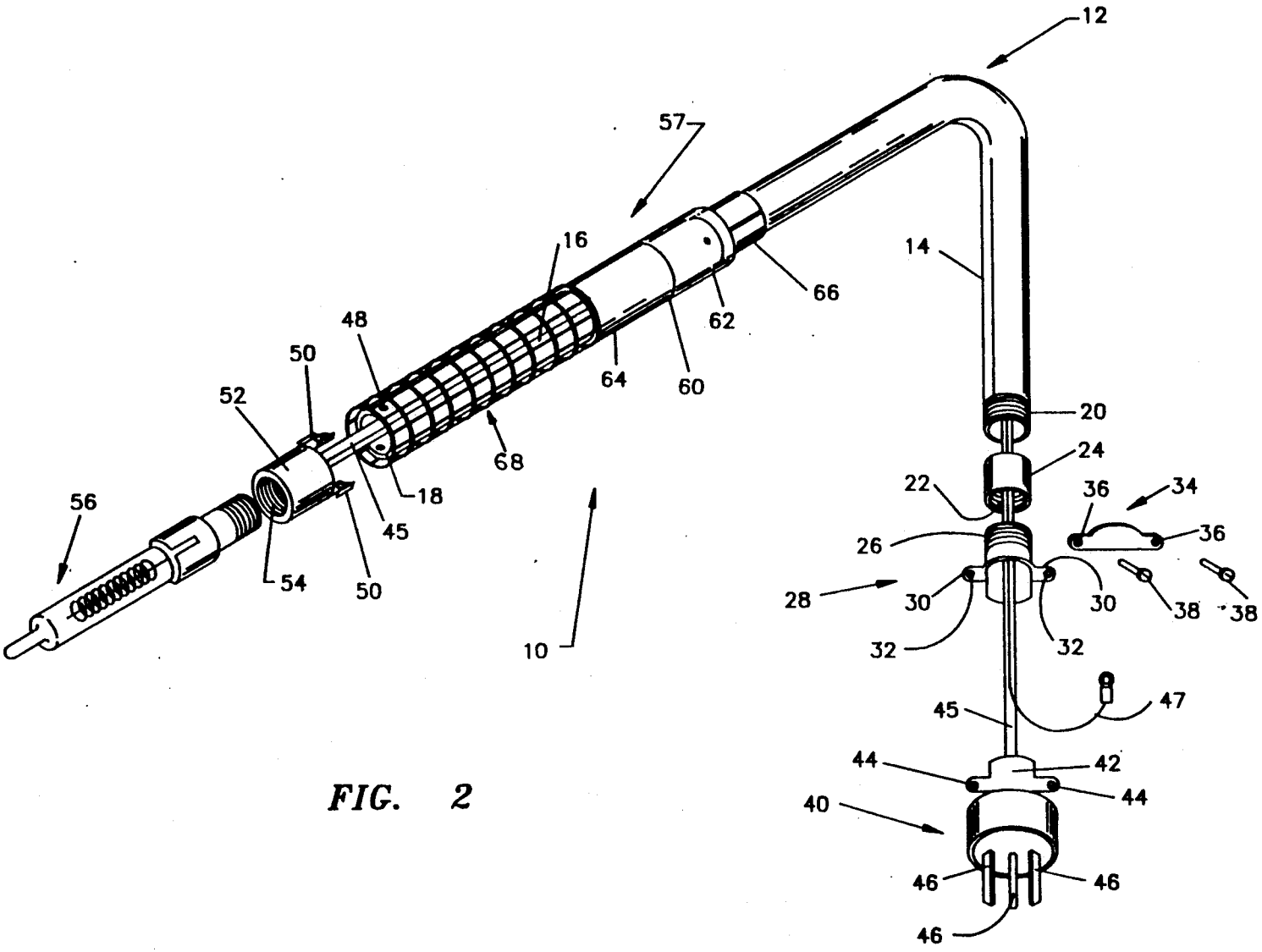
FIG. 2 is an exploded view of the portable electric lamp of the present invention showing its retractable guard in the lamp exposed position.

Referring now to the drawings, FIGS. 1 and 2 illustrate, by way of example, the preferred embodiment of the present invention. As best shown in FIG. 2, the portable electric lamp 10 comprises a generally L-shaped conduit 12 having a first end portion 14, an intermediate section 16 and a second end portion 18. First end portion 14 of conduit 12 has external threads 20 at its distal end for connection with internal threads 22 of a coupling 24. Coupling 24 is also connected through its internal threads 22 to the external threads 26 of clamp connector 28. Clamp connector 28 further includes a pair of wing sections 30 having tapped openings 32 therein, a separate clamp member 34 having openings 36 therein spaced apart the same distance as the tapped openings 32 for receiving threaded screws 38. A wire plug 40 is provided for insertion in an electrical receptacle to supply power to the lamp assembly. Wire plug 40 includes a wing section 42 at one end having spaced openings 44 therein, conventional connection means (not shown) for connected to one end of a conventional three wire cable 45, and conventional male connections 46 at its other end for insertion into conventional female receptacles (not shown) mounted to a structure (not shown) or to one end of a conventional extension cord (not shown).

Second end portion 18 of conduit 12 has openings 48 therein for receiving screws or pop rivets 50 for securing a conventional socket or lamp holder 52 to the second end portion 18 of conduit 12. Socket 52 includes internal threads 54 therein for receiving a quartz halogen lamp 56 and conventional connections (not shown) for connection to three wire cable 45. Three wire cable 45 together with an additional ground wire 47 is threaded through the hollow core of conduit 12 with cable 45 being connected to plug 40 and socket 52 and ground wire 47 being connected to clamp connector 28 and socket 52.

A lamp guard 57 is slideably mounted on the intermediate section 16 and second end portion 18 of conduit 12. Lamp guard 57 comprises a hollow hose or pipe 60 having a first end 62 and a second end 64, a bushing 66 secured to first end 62 of hose 60, and a retractable protective cover 68 secured to second end 64 of hose 60. Retractable protective cover 68 takes the form of a cage and can be fabricated from a wire mesh or similar material which is secured to second end 64 of hollow hose or pipe 60 by any conventional means such as adhesives or duct tape. The frictional fit between the interior surfaces of bushing 66 and the hose 60 with the external surfaces of conduit 12 is such that lamp guard 57 will normally remain in its lamp covering position as shown in FIG. 1 and in its retracted or lamp exposing position as shown in FIG. 2 responsive to being placed in either of these positions. As is apparent, means can be readily incorporated in lamp guard 57 to lock lamp guard 57 in its lamp covering position.

Figure 4:
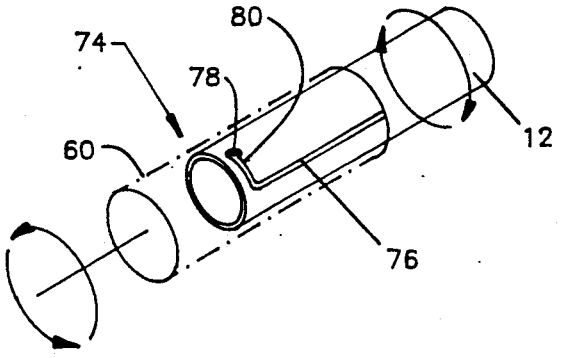
FIG. 4 is a pictorial view illustrating a locking assembly for retaining the retractable guard in its protecting position. The retractable guard member is shown in dot-dash lines.

One such locking assembly 74 is shown in FIG. 4 and includes a groove or slot 76 disposed longitudinally along conduit 12 and a protruding pin or dimple 78 extending from pipe 60 into the groove or slot 76 which is provided with a curved end portion 80. To retain the cage over the halogen lamp, pipe 60 is moved along conduit 12 with pin 78 riding in slot or groove 74 until the pin engages curved end portion 80. Subsequent to the engagement of pin or dimple 78 with curved end portion 80, pipe 60 or conduit 12 is rotated to lock the pin in the end curved portion.

When assembled, openings 44 in wing section 42 of plug 40, openings 36 in clamp member 34 and threaded openings 32 in wing section 30 are aligned to receive threaded screws 38 which secures wire plug 40 and ground wire 47 to clamp connector 28.

Conduit 12 is preferably made of aluminum, but may be made of other metals, PVC or other suitable material. Hollow hose or pipe 60 may be made of rubber, metal, PVC or any other suitable material. The several parts of the portable lamp of the present invention need not be joined together by the means depicted in the drawings, but may be joined by other suitable means such as adhesives, bolts or the like.

Bulb 56 might be any suitable bulb of various wattages. It has been found that a 500 watt bulb provides adequate illumination for most usages of the portable electric lamp of the present invention. A bulb corresponding to bulb 56 shown in the drawing is available from IWASAKI Electric Co., Ltd. under the trade designation EYE HALOGEN LAMP, Model JD2049, 130V, 500W M2.

Figure 3:
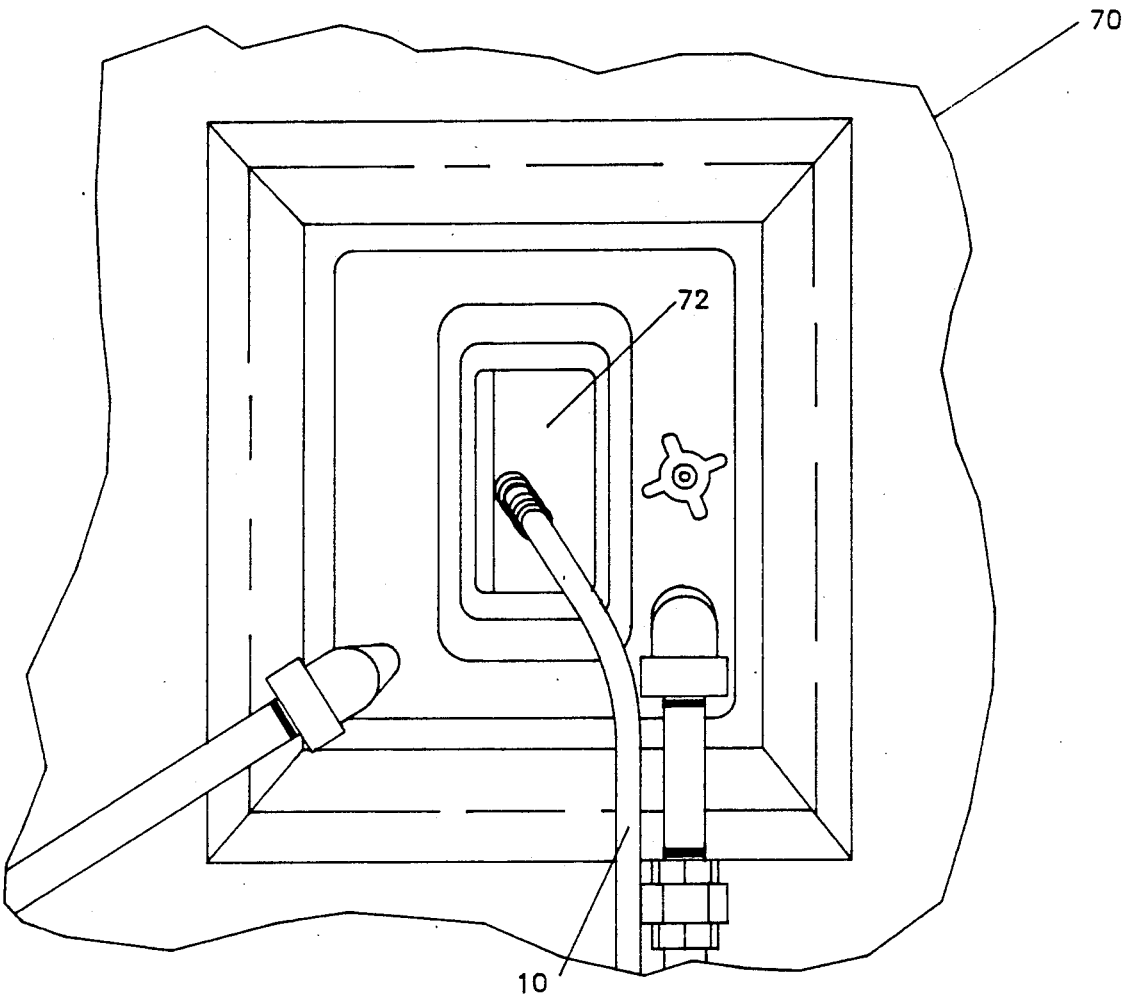
FIG. 3 is a partially broken away view of a boiler furnace showing a portable electric lamp of the instant invention inserted in and being supported in an observation port of the boiler furnace.

FIG. 3 illustrates, by way of example, a broken away section of a boiler furnace 70 having an observation port 72 therein which has been opened and which supports one of the portable electric lamps 10.

While the above description constitutes a preferred embodiment of the present invention, it will be appreciated that the invention is susceptible to modification, variation and change without departing from the proper scope and fair meaning of the accompanying claims.

I claim:

1. A portable electric lamp comprising:

a. a hollow conduit including a first end portion, an intermediate section and a second end portion;

b. a clamp connector secured to said first end portion of said hollow conduit;

c. socket means secured to said second end portion of said hollow conduit;

d. an elongated electric bulb having an illuminating-generating section and a current receiving section at one of its distal ends, said current receiving section being secured to said socket means;

e. plug means secured to said clamp connector;

f. conducting means positioned within said conduit and being operatively connected to said socket means and said plug means for routing current from a power source to said current receiving section of said bulb;

g. a retractable guard slideably mounted upon said intermediate section and second end portion of said conduit to a first position where it covers or protects said bulb to a second position where it exposes said bulb to enable the cleaning or replacement of said bulb; and h. means for retaining said retractable guard in its said first and second positions said means for retaining said retractable guard in said second position comprises a frictional fit between said conduit and said retractable guard.

2. The portable electric lamp of claim 1 wherein said bulb is a halogen quartz lamp including threads adjacent its said current receiving section for engaging threads in said socket means thereby securing said bulb to said socket means.

3. The portable electric lamp of claim 2 wherein said retractable guard comprises a hollow hose member having a first end portion, a second end portion and a cage attached to said second end portion.

4. The portable electric lamp of claim 3 wherein said cage is formed of a circular wire cloth joined at two of its edges and having a plurality of openings therein to allow illumination to be dispersed therethrough when said guard is in its said first position.

5. The portable electric lamp of claim 4 wherein said means for retaining said guard in its said first position includes a frictional fit between said conduit and said hollow hose member..

6. The portable electric lamp of claim 4 wherein said means for retaining said guard in its first position includes an elongated slot disposed longitudinally along said hollow conduit, said slot having a curved end portion at the distal end thereof, and, a protruding member protruding from said hollow hose member into said slot for retained engagement in said curved end portion of said slot.

7. A portable electric lamp for use in servicing very large enclosed areas, said lamp comprising:

a. conduit means including a first end portion, an intermediate section and a second end portion;

b. connection means secured to said first end portion of said conduit means;

c. internally threaded socket means secured to said second end portion of said conduit means;

d. electric halogen bulb means having an illuminating section at one of its distal ends and a current receiving section at its other distal end, said current receiving section having external threads for connection with said internally threaded socket means;

e. plug means secured to said connection means;

f. means positioned within said conduit means and being operatively connected to said socket means and said plug means for conducting current from a power source to said electric socket means;

g. retractable means slideably mounted upon said conduit means between a first position where it covers or protects said bulb means and a second position where it exposes said bulb means to enable the cleaning or replacement of said bulb means; and h. means for retaining said retractable means in its said first and second positions, said means for retaining said retractable guard in said second position comprises a frictional fit between said conduit and said retractable guard

8. The portable electric lamp of claim 7 wherein said retractable means comprises a hollow hose member having a cage attached thereto for covering said bulb means when said retractable means is in its said first position.

9. The portable electric lamp of claim 8 wherein said cage is formed of a circular wire cloth joined at two opposed edges and having a plurality of openings therein to allow illumination to be dispersed therethrough when said retractable means is in its said first position.

10. A portable electric lamp for use in servicing very large enclosed areas, said lamp comprising:

a. conduit means including a first end portion, an intermediate section and a second end portion;

b. connection means secured to said first end portion of said conduit means;

c. socket means secured to said second end portion of said conduit means;

d. electric halogen bulb means having an illuminating section at one of its distal ends and a current receiving section at its other distal end, said current receiving section having means for connection with said socket means;

e. plug means secured to said connection means;

f. means positioned with said conduit means and being operatively connected to said socket means and said plug means for conducting current from a power source to said socket means;

g. retractable means slideably mounted upon said conduit means and movable between a first position where it covers or protects said bulb means and a second position where it exposes said bulb means too enable the cleaning or replacement of said bulb means said retractable means being retained in said second position by a friction fit between said conduit and said retractable means.

11. The portable electric lamp of claim 10 wherein said retractable means comprises a hollow hose member having a cage attached thereto for covering said bulb means when said retractable means is in its said first position..

12. The portable electric lamp of claim 11 wherein said cage is formed of material having a plurality of openings therein to allow illumination to be dispersed therethrough when said retractable means is in its said first position.

13. The portable electric lamp of claim 12 including means for retaining said retractable means in its said first position responsive to said retractable means being slideably moved to said first position.

14. The portable electric lamp of claim 13 including said means for retaining said retractable means n its said second position responsive to said retractable means being slidably moved too said second position.

* * * * *